US005123682A

United States Patent [19]

Robida et al.

[11] Patent Number: 5,123,682

[45] Date of Patent: Jun. 23, 1992

[54] CYLINDRICAL LOCK ASSEMBLY

[75] Inventors: James E. Robida, Cobalt; Edward T. Leitkowski, Jr., Colchester, both of Conn.

[73] Assignee: Emhart Inc., Newark, Del.

[21] Appl. No.: 596,881

[22] Filed: Oct. 12, 1990

[51] Int. Cl.[5] ..... E05C 1/16

[52] U.S. Cl. ..... 292/169; 292/337

[58] Field of Search ..... 292/169.23, 357, 337, 292/348, 169.16, 169.22, 169

[56] References Cited

U.S. PATENT DOCUMENTS

| | | | |
|---|---|---|---|
| 2,012,912 | 8/1935 | Hurd | 70/91 |
| 3,293,892 | 12/1966 | Falk | 70/364 |
| 4,067,599 | 1/1978 | Ohno | 292/357 |
| 4,728,133 | 3/1988 | Valley | 292/357 |
| 4,930,822 | 6/1990 | Shen | 292/357 |

*Primary Examiner*—Richard E. Moore
*Attorney, Agent, or Firm*—J. Bruce Hoofnagle

[57] ABSTRACT

A cylindrical lock assembly (20) includes an inside subassembly (22) and an outside subassembly (24) which are assembled with a door (326). Each subassembly (22,24) includes a rose liner (26,38), a return spring cassette (28,40), a rose (30,42), a lever (32,46) and a lever insert (34,48). The inside subassembly (22) also includes a turn button (36) and the outside subassembly (24) includes a cylinder lock (44).

A pair of mounting blocks (258,260) are contained within the chassis (50) to facilitate threaded connection of the chassis to the rose liners (26,38) which are assembled on respective sides of the door (326) and thereby provide an anti-rotation mounting for the chassis.

9 Claims, 6 Drawing Sheets

CYLINDRICAL LOCK ASSEMBLY

CROSS-REFERENCE TO RELATED APPLICATIONS

The following applications are cross referenced herein as related applications, are filed on even date herewith, and are incorporated herein, by reference thereto.

1. Title: Cylinder Lock
Applicants: James E. Robida; Richard M. Davidian; Vladimir Freilich
U.S. Ser. No. 07/596,888, filed Oct. 12, 1990
2. Title: Cylindrical Lock Assembly
Applicants: James E. Robida; Kenneth W. Strickland
U.S. Ser. No. 07/596,451, filed Oct. 12, 1990
3. Title: Cylindrical Lock Assembly
Applicants: Mohammed A. Haq; Edward T. Leitkowski, Jr.
U.S. Ser. No. 07/596,882, filed Oct. 12, 1990
4. Title: Cylindrical Lock Assembly
Applicants: James E. Robida; Kenneth W. Strickland
U.S. Ser. No. 07/596,890, filed Oct. 12, 1990

BACKGROUND OF THE INVENTION

This invention relates to a cylindrical lock assembly and particularly to a cylindrical lock assembly having structure which prevents rotation of the chassis upon operation of the assembly.

Currently, a cylindrical lock assembly is assembled with a door and typically includes a chassis with rollbacks or sleeves extending on opposite sides of the chassis which support operators such as knobs and levers. A latchbolt extends from the chassis and is movable upon rotation of the operators. A pair of rose liners are attached to the chassis and include tabs which are located within openings in the door to provide some opposition to rotation of the chassis upon rotation of the operators.

While this type of anti-rotation facility is effective when a knob operator is used, it is not effective when a lever operator is used. The result is that the linkage and connection between the latchbolt and the chassis becomes misaligned and the latchbolt tends to bind and is thereby unoperative.

Thus, there is a need for an anti-rotation facility which will provide sufficient resistance to rotation of the chassis upon rotation of the lever to allow free and smooth movement of the latchbolt as the lever is operated.

SUMMARY OF THE INVENTION

In view of the foregoing problem, it is an object of this invention to provide a cylindrical lock assembly which includes an anti-rotation facility for resisting rotation of a chassis of the assembly upon operation of an operator of the assembly.

Another object of this invention is to provide a cylindrical lock assembly which includes facility for the unbinding operation of a latchbolt of the assembly upon operation of an operator thereof.

With these and other objects in mind, this invention contemplates a cylindrical lock assembly for assembly with a door which includes a latchbolt and a chassis containing a mechanism for moving the latchbolt between a latched position and an unlatched position. A sleeve extends from the chassis and is attached thereto for operating the mechanism upon rotation of the sleeve. An operator is mounted on the sleeve for facilitating selective rotation of the sleeve. Means are positioned on the sleeve and attachable to the door for attaching the chassis to the door. Anti-rotation means are mounted on the chassis and are coupled to the attaching means for providing resistive force to rotation of the chassis upon operation of the operator.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

Figure 1:
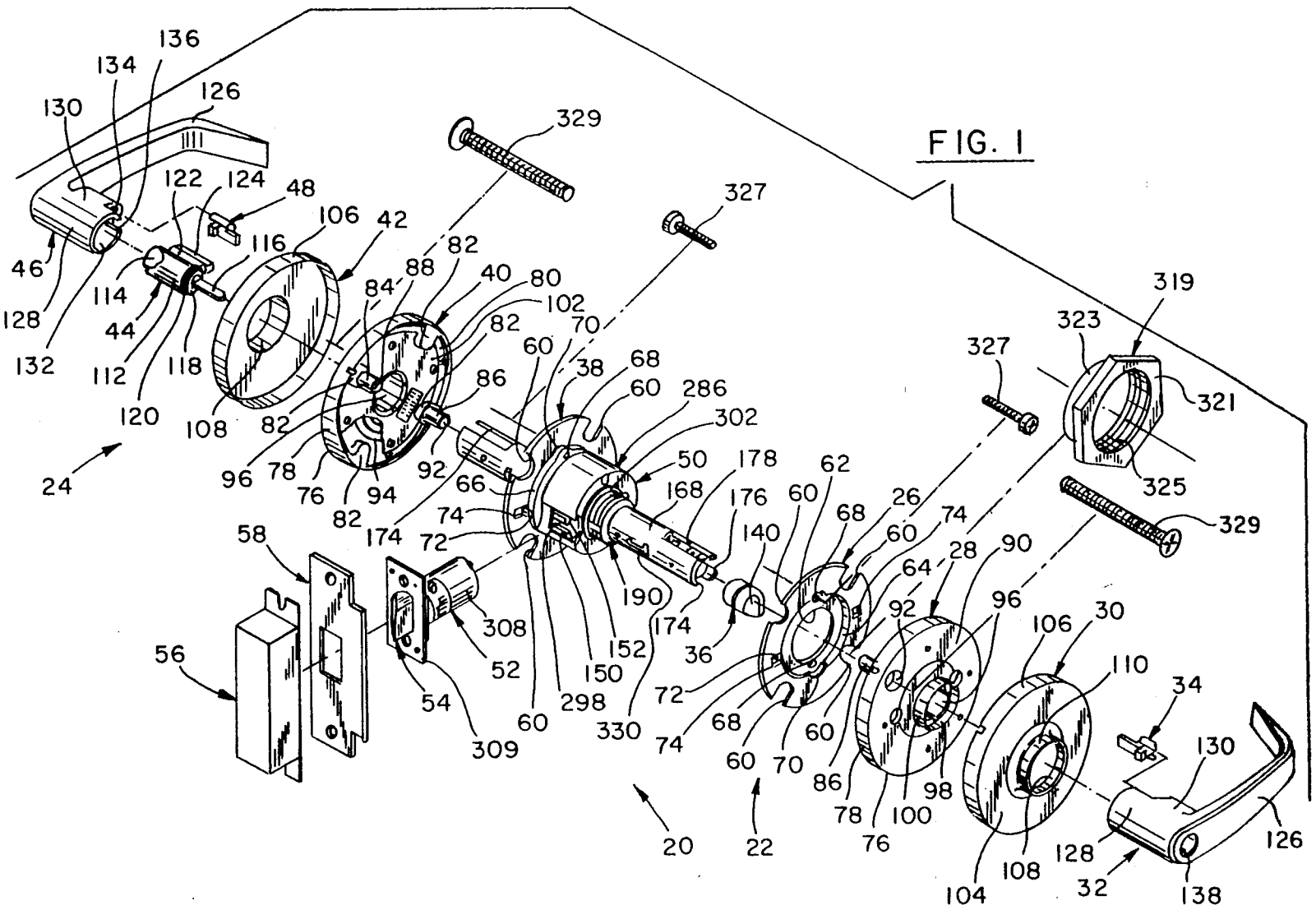
FIG. 1 is an exploded perspective view of a cylindrical lock assembly embodying certain principles of the invention.

As illustrated in FIG. 1, a cylindrical lock assembly 20 includes an inside subassembly 22 and an outside subassembly 24. The inside subassembly 22 includes a rose liner 26, a return spring cassette 28, a rose 30, a lever 32, a lever insert 34 and a turn button 36. The outside assembly 24 includes a rose liner 38, a return spring cassette 40, a rose 42, a cylinder lock 44, a lever 46 and a lever insert 48.

A chassis 50 is located between the inside subassembly 22, and the outside subassembly 24. A latch assembly 52 is positioned for operable attachment to chassis 38 and includes a latchbolt 54 which extends outwardly from the latch assembly in an extended or latched position in a direction away from the chassis 50. A strike box 56 and a strike 58 are mounted in a door frame (not shown) in cooperation with the cylindrical lock assembly 20.

Rose liners 26 and 38 are each formed in a circular configuration with four equally spaced slots 60 in the periphery thereof. Each of the liners 26 and 38 are formed with an axial opening 62, as illustrated with respect to liner 26, around which is formed a circular depression 64 on one side thereof and which appears as a protruding section 66 on the opposite side thereof as illustrated with respect to rose liner 38. A pair of screw holes 68 are formed in the depression 64 and through the protruding section 66 with clearance walls 70 formed therearound. A pair of tabs 72 are formed by punching holes 74 through the rose liners 26 and 38 with the tabs extending toward the other rose liners.

Cassettes 28 and 40 each include a circular housing 76 formed with a side wall 78 to form a dish-like cavity 80. Four equally spaced pads 82 are formed in the cavity and extend radially inwardly from side wall 78. The pads 82 are formed with an exterior configuration which is consistent with the shapes of slots 60 of rose liners 26 and 38. A pair of posts 84 and 86 are formed on two oppositely spaced pads 82 and extend outwardly from cavity 80. Post 84 is formed with an axial hole 88 which is threaded and extends through the post but does not extend through an outer face 90 which is illustrated on cassette 28. Post 86 is formed with an unthreaded hole 92 which extends through outer face 90.

A coil or torsion spring 94 and a lever arbor 96 are positioned in a concentric axial arrangement within cavity 80 so that the arbor extends into and partially through an axial opening 98 formed through outer face 90 and a hub 100 which extends outwardly from the outer face. Also, arbor 96 is mounted for rotary movement relative to housing 76. An outer end of spring 94 is attached to an adjacent portion of cavity 80 to preclude movement of the outer end. An inner end of spring 94 is attached to arbor 96 for movement with the arbor thereby allowing compression of the coil spring. A cover 102 is positioned within cavity 80 and over coil spring 94 and arbor 96 and is fastened to housing 76 to retain the spring and arbor in the concentric and axial arrangement within the cavity.

Roses 30 and 42 are each formed with a circular face 104 and a side wall 106. An axial opening 108 is formed through the face 104 and extends through a hub 110 which extends outwardly from the face.

Cylinder lock 44 includes a cylinder shell 112 with a central axial opening for receiving a cylinder plug 114. A tailpiece 116 extends axially from one end of plug 114 and though a tailpiece anchor plate 118 which is held with shell 112 by a threaded cap 120. A tumbler supporting rib 122 is formed integrally with shell 112 and extends laterally therefrom. A tumbler cover 124 is positioned over the outer portion of rib 122 to contain pin tumblers which are contained within the rib in alignment with mating portions of plug 114 to provide a key-operated locking facility.

Levers 32 and 46 each include a handle 126 which is formed integrally with a hub 128. A protrusion 130 is formed integrally with handle 126 and hub 128 at the inner corner of the juncture of the handle and hub. Hub 128 is formed with an axial opening 132 which communicates with an opening 134 formed in protrusion 130. Further, a slot 136 is formed in hub 128 which communicates with the outward end portion of axial opening 132 formed in the hub. An opening 138 is formed through handle 126 in axial alignment with, and in communication with, axial opening 132. Opening 138 is of a smaller diameter than the diameter of opening 132.

Turn button 36 is formed with a finger-grip end 140 at one end thereof which normally protrudes from opening 138 of lever 32. An attachment structure is formed at the opposite end of turn button 36 for engagement with elements within chassis 50 to facilitate locking of the latchbolt 54 in the extended position or latched by rotation of the button.

Figure 3:
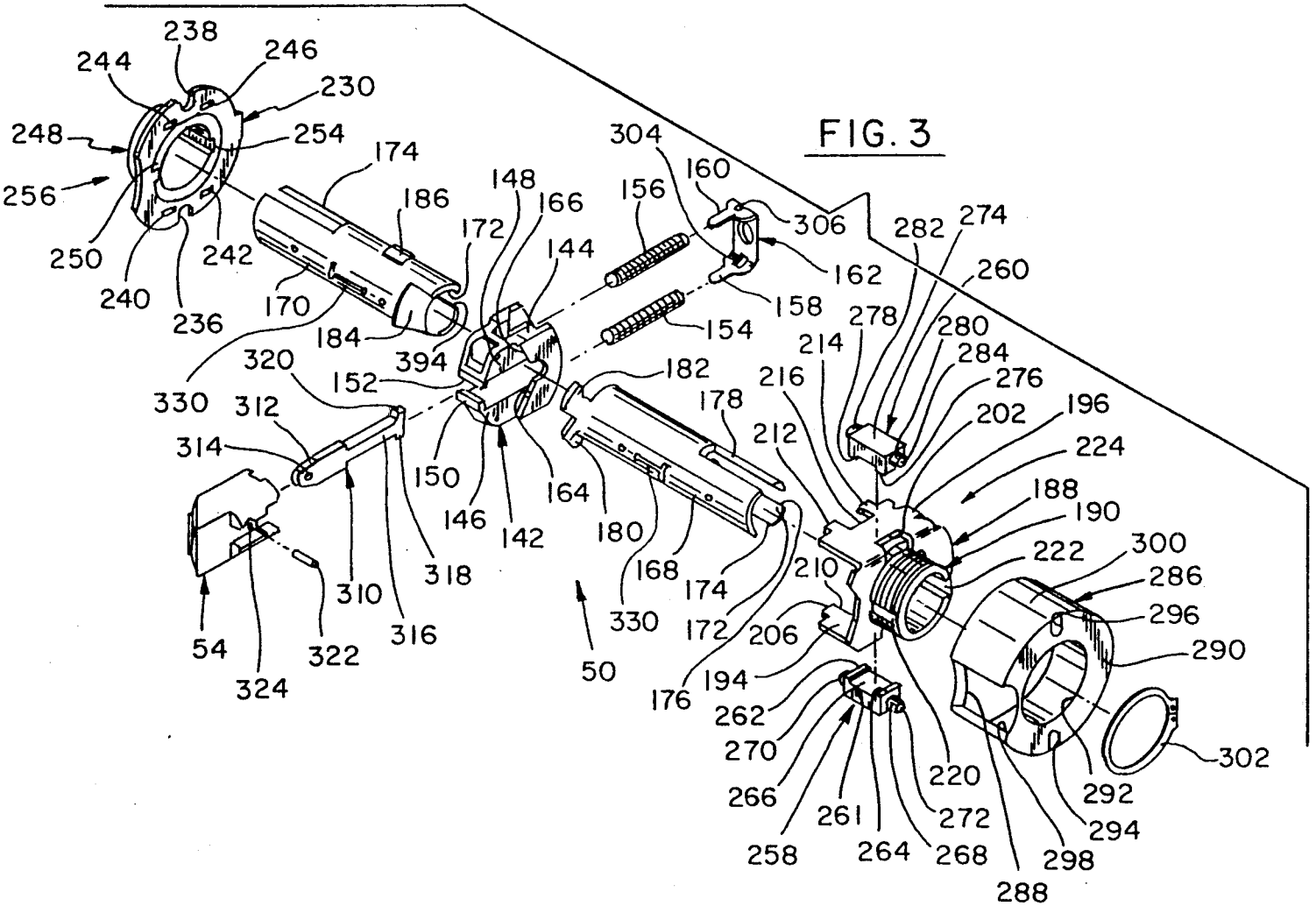
FIG. 3 is an exploded perspective view of a chassis of the cylindrical lock assembly of FIG. 1 embodying certain principles of the invention.

Referring now to FIGS. 1 and 3, chassis 50 includes a retractor 142 which is formed with a rear support 144 and a pair of vertically spaced, horizontally extending arms 146 and 148. The facing ends of arms 146 and 148 are formed with lips 150 and 152, respectively. A pair of pockets (not shown) are formed in the rear of support 144 to receive one end of a pair of compression springs 154 and 156. The opposite ends of springs 154 and 156 are positioned over a pair of spaced fingers 158 and 160, respectively, of an integrally formed retainer 162. Retractor 142 is formed with a pair of cam surfaces 164 and 166 on one side thereof. A similar pair of cam surfaces (not shown) are formed on the opposite side of retractor 142.

A pair of rollbacks or sleeves 168 and 170 are each formed with an axial through hole 172 and with slots 174, 176, and 178 in one end thereof. Slots 174 and 178 are aligned-vertically and slot 176 is located on one side of the sleeves 168 and 170 angularly spaced by ninety degrees from slots 174 and 178. Sleeve 168 is formed with a pair of camming elements 180 and 182 which are formed by rolling back portions of the sleeve which extend from the end of the cylindrical portion of the sleeve. A single camming element 184 is formed from sleeve 170. A tab 186 protrudes outwardly from an intermediate portion of each of the sleeves 168 and 170. As illustrated in FIG. 3, tab 186 protrudes from an upper surface of sleeve 170. Tab 186 of sleeve 168 extends from a lower surface of the sleeve but is not visible in FIG. 3.

Figure 4:
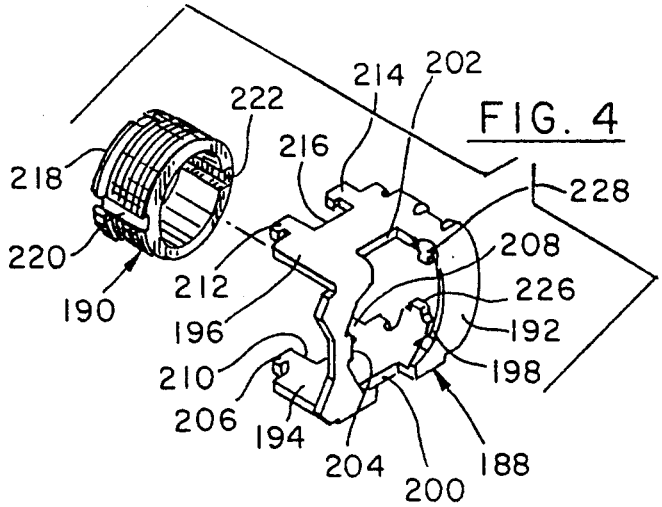
FIGS. 4 and 5 are exploded perspective views of components of the chassis of FIG. 3.

Referring to FIGS. 3 and 4, chassis 50 further includes a case 188 and a sleeve 190. Case 188 is formed in a U-shaped configuration having a base 192 and a pair of legs 194 and 196 formed integrally with the base. Base 192 is formed with an opening 198 which communicates with a pair of notches 200 and 202 formed in the legs 194 and 196, respectively, at the junctures of the legs and the base. Base 192 is further formed with a tab 204 which protrudes slightly into opening 198. Leg 194 is formed with a pair of spaced, hook-like tabs 206 and 208 at the free end of the leg with a notch 210 formed in the free end of the leg between the tabs. In similar fashion, leg 196 is formed with a pair of spaced, hook-like tabs 212 and 214 at the free end of the leg with a notch 216 formed in the free end of the leg between the tabs.

Sleeve 190 is formed in a cylindrical shape with a flange 218 at one end thereof which has a diameter greater that the diameter of the opening 198 of case 188. The periphery of sleeve 190 is threaded and is formed with a longitudinal slot 220 therein. Further, a longitudinal slot 222 is formed in the inner wall of sleeve 190.

As illustrated in FIG. 3, the threaded portion of the sleeve 190 is inserted between legs 194 and 196 and through opening 198 of case 188 with flange 218 resting against the inner surface of base 192 adjacent the opening. In this arrangement, the threaded portion of the sleeve 190 extends from the outer surface of base 192 and combines with case 188 to form a case assembly 224.

Referring again to FIG. 4, an inwardly turned tab 226 is formed along a side edge of leg 194 of case 188. In similar fashion, an inwardly turned tab 228 is formed along a side edge of leg 196 of case 188 in spaced and aligned relation with tab 226.

Figure 5:
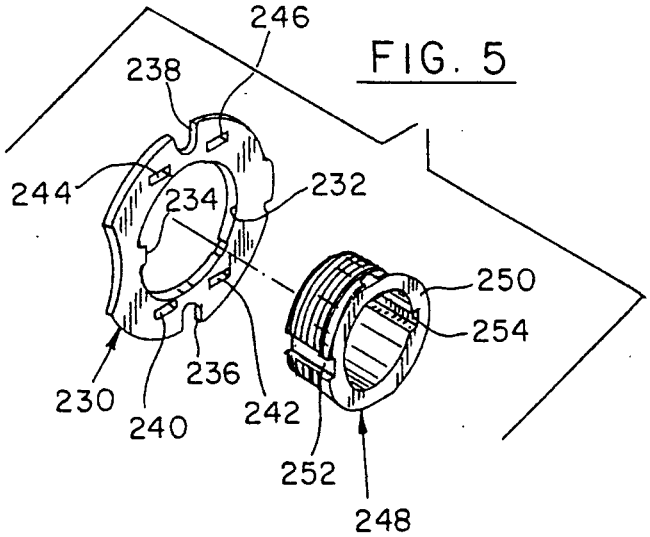

Referring to FIGS. 3 and 5, a cap 230 in generally circular and is formed with a central opening 232 and a tab 234 protruding inwardly into the opening. A pair of diametrically opposed slots 236 and 238 are formed in the periphery of cap 230. Four spaced through holes 240, 242, 244 and 246 are formed in cap 230. A sleeve 248 is of cylindrical shape and is formed with a flange 250 at one end thereof which has a diameter larger than the diameter of opening 232. The peripheral surface of sleeve 248 is threaded and is formed with a longitudinal slot 252. A longitudinal slot 254 is formed in the inner wall of sleeve 248. As illustrated in FIG. 3, cap 230 and sleeve 248 are assembled to form a cap assembly 256 with the threaded portion of the sleeve inserted through opening 232 and extending outwardly from the cap. In this position, flange 250 is flush against the adjacent surface of cap 230.

As illustrated in FIG. 3, chassis 50 further includes a pair of spaced mounting blocks 258 and 260. Block 258 is formed with a central body 261 and a pair of spaced pedestals 262 and 264 which extend outwardly from opposite ends of a surface 266 of the body. A pair of posts 268 and 270 extend from opposite ends of body 261 of block 258 with a threaded hole 272 extending longitudinally through the body and the posts. Block 260 is formed in identical fashion with a body 274 and spaced pedestals 276 and 278 extending from one surface of the body. A pair of posts 280 and 282 extend from opposite ends of the body 274 and a threaded hole 284 extends longitudinally through the body and the posts.

Referring again to FIG. 3, chassis 50 includes a housing 86 which is generally of cylindrical shape. One side 288 of housing 286 is completely open while the other side 290 is formed with a smaller opening 292. Also, side 290 is formed with spaced holes 294 and 296. An opening 298 is formed in the peripheral surface 300 of housing 286. Chassis 50 further includes a retaining ring 302.

In assembly of the components of chassis 50,sleeves 168 and 170 are positioned so that camming elements 180 and 182 are located between cam surfaces 164 and 166 and camming element 184 is located adjacent to an associated cam surface on retractor 142. The forward ends of springs 154 and 156 are positioned in mating pockets of retractor 142 and the rear ends of the springs are positioned over fingers 158 and 160. This forms a retractor subassembly.

The retractor subassembly is then located so that sleeve 168 is positioned through and extends outwardly from the axial opening of sleeve 190. In this position, retractor 142 is located in the space between legs 194 and 196 and close to the inner surface of base 192. Retainer 162 is formed with a pair of spaced slots 304 and 306 which rest over tabs 226 and 228 of case 188 thereby placing springs 154 and 156 in a contained position for subsequent compression.

Cap assembly 256 is then positioned over sleeve 170 with tabs 206, 208, 212 and 214 of case 188 being located in and through holes 240, 242, 244, 246, respectively.

In this fashion, retractor 142 the inward ends of sleeves 168 and 170, spring 154 and 156 and retainer 162 are contained within the enclosure formed by the securance of cap assembly 256 with case 188.

Pedestals 262 and 264 of block 258 are positioned in notches 200 and 210, respectively of case 188 and pedestals 276 and 278 of block 260 are positioned in notches 202 and 216, respectively, of the case. Housing 286 is then manipulated so that sleeve 168 extends outwardly from opening 292 of the housing and sleeve 170 extends outwardly from open side 288 of the housing. In this arrangement, the secured cap assembly 256 and case 188, and the elements contained therein as noted above, are located within housing 286 with lips 150 and 152 of retractor 142 exposed through opening 298 of the housing.

Retaining ring 302 is positioned about the threaded portion of sleeve 190 and against side 290 of housing 286 to retain the elements of chassis 50 in the assembly as described above.

It is noted that in the assembled chassis 50, the threaded holes 272 and 284 of blocks 258 and 260, receptively, are aligned with slots 236 and 238, respectively, of cap assembly 256 and holes 294 and 296, respectively, of housing 286. Also, as illustrated in FIG. 1, rose liner 38 is positioned over sleeve 170 and the threaded portion of sleeve 248 of cap assembly 256 and located adjacent the open side 288 of housing 286. In this position, screw holes 68 of rose liner 38 are aligned with the threaded holes 272 and 284 of blocks 258 and 260, respectively. Screws can then be placed through screw holes 68 of rose liner 38 and threadedly secured within one end of holes 272 and 284 of blocks 258 and 260, respectively, to secure the rose liner with the chassis 50.

Referring now to FIGS. 1 and 3, latch assembly 52 includes a latch case 308 which is secured at one end thereof to a front plate 309. Latchbolt 54 is contained partially within case 308 and extends outwardly therefrom to the extended position and through an opening in front plate 309. It is noted that latchbolt 54 is retractible into case 308 to a retracted or unlatched position. Therefore, latchbolt 54 is movable between the extended or latched position and the retracted or unlatched position. As viewed in FIG. 3, a tail piece or link 310 is formed with a head 312 and lateral through hole 314 at one end thereof. Link 310 is formed with a T-shaped tail 316 at the other end thereof and includes cross arms 318 and 320. Head 312 is located within a slot (not shown) formed in rear of latchbolt 54 and is pivotally secured thereto by a pin 322 which is inserted through aligned holes, including a hole 324, formed in the latchbolt and hole 314 formed in the head.

Head 312 and the portion of latchbolt 54 to which the head is attached are contained within case 308. Tail 316 extends from the rear of case 308 and is designed to be positioned eventually through opening 298 of housing 286 with cross arms 318 and 320 being located behind lips 150 and 152 of retractor 142. In this fashion, upon rotation of sleeves 168 or 170, camming elements 180 and 182 will engage cam surfaces 164 and 166 to urge retractor 142 rearwardly against the biasing of springs 154 and 156. As retractor 142 is moved rearwardly, link 310 is pulled with the retractor to withdraw latchbolt to the retracted position.

Figure 2:
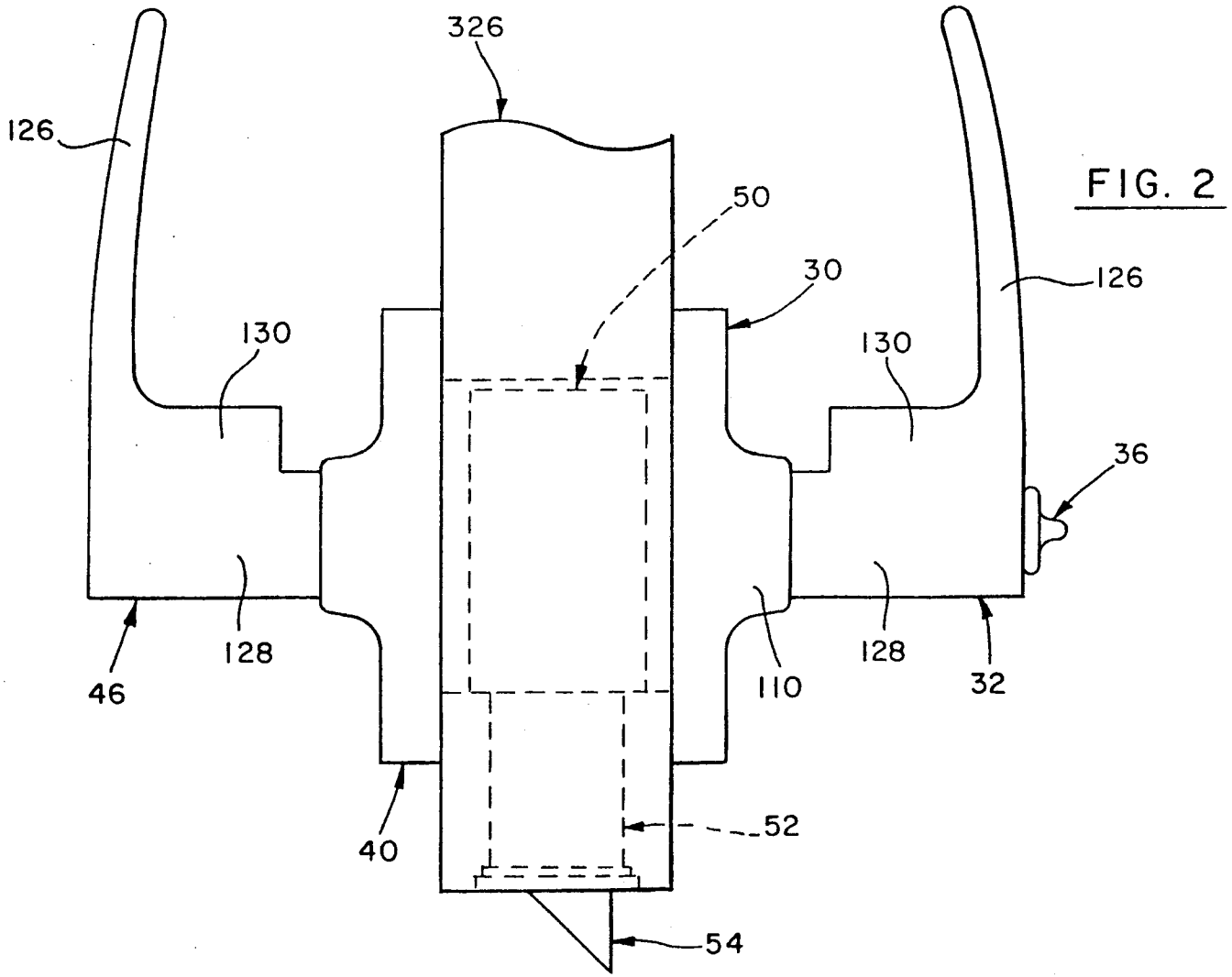
FIG. 2 is a plan view of the cylindrical lock assembly of FIG. 1 assembled with a door.

In further assembly of the components of cylindrical lock assembly 20 of FIG. 1, case 308 of latch assembly 52 is positioned within an opening (not shown) in the edge of a door 326 (FIG. 2) which communicates with a larger door opening which later receives chassis 50. Chassis 50 with attached rose liner 38 is then inserted through the larger door opening in door 326 where the door opening is slightly larger in diameter than the diameter of housing 286. As chassis 50 is moved into the larger opening, the chassis engages and becomes attached to the tail-end of latch case 308. Also, tabs 72 of rose liner 38 are moved into notches in the door and the rose liner is flush with the adjacent surface of the door. In this position, housing 286 is located within the door opening and sleeves 168 and 170 extend from opposite sides of the door. Tail 316 of link 310 is then attached to retractor 142 in the manner previously described and plate 309 is secured to the edge of door 326 in a conventional manner. Rose liner 26 is then moved over sleeve 168 and toward door 326 whereby tabs 72 are moved into notches formed in the adjacent surface of the door and screw holes 68 are aligned with the other ends of threaded holes 272 and 284 of blocks 258 and 260, respectively. Thereafter, a hex nut 319 having a hex flange 321 and a sleeve section 323 with a threaded axial hole 325 is threadedly mounted onto sleeve 190 until the hex flange seats in the depression 64 of rose liner 26. Screws, such as screws 327, are then positioned through holes 68 of rose liner 26 and threadedly into holes 272 and 284 to secure the rose liner in the assembled position. In this position, the head of screw 327 is located adjacent the periphery of an adjacent flat of hex flange 321 so that the screw head prevents the hex nut 319 from loosening.

It is noted that in assembling rose liners 26 and 38 in the manner described above, slots 60 of rose liner 26 are aligned with corresponding slots 60 of rose liner 38.

Cassettes 28 and 40 are then positioned over sleeves 168 and 170 so that tabs 186 are positioned within longitudinal slots formed in the cylindrical opening of arbors 96 of the cassettes. In this manner, arbors 96 are keyed to sleeves 168 and 170 to rotate upon rotation of the sleeves. As cassettes 28 and 40 are moved over sleeves 168 and 170, pads 82 of the cassettes are located in respective slots 60 of rose liners 26 and 38, respectively. As cassettes 28 and 40 are assembled in this fashion, posts 84 and 86 of each of the cassettes, are located with corresponding openings (not shown) in door 326. In this arrangement, post 84 of cassette 40 is axially aligned with post 86 of cassette 28 and post 86 of cassette 40 is axially aligned with post 84 of cassette 28. The threaded end of a screw 329 is placed through unthreaded hole 92 of post 86 from the outer face 90 of cassette 28 and into threaded hole 88 of post 84 of cassette 40. In similar fashion, the threaded end of another screw 329 is placed through unthreaded hole 92 of post 86 from the outer face of cassette 40 and into threaded hole 88 of post 86 of cassette 28. The screws 329 are then tightened to draw cassettes 28 and 40 to a secure position on opposite sides of door 326 whereby the heads of the screws come to rest in countersunk holes in the outer faces 90 of the cassettes in alignment with post holes 86.

Roses 30 and 42 are then positioned over cassettes 28 and 40, respectively, and are held in assembly by a dimple and detent arrangement (not shown) formed in complimentary fashion in the roses and cassettes. Other arrangements could be used to secure roses 30 and 42 with cassettes 28 and 40, respectively, such as, for example, a dimple and L-shaped slot arrangement (not shown). One end of turn button 36 is then positioned within sleeve 168 to mate with conventional locking facilities within chassis 50 to permit selective locking of latchbolt 54 in the extended position upon turning of the turn button. Insert 34 is positioned within an inward opening of protrusion 130 of lever 32. Thereafter, opening 138 of lever 32 is positioned onto and over sleeve 168 so that finger-grip end 140 of turn button 36 extends through the outward end of opening 138.

It is noted that turn button 36 is spring-biased outwardly from sleeve 168 but is formed with a flange which precludes movement of the button axially outwardly from opening 138 other than the extended finger-grip end 140. It is further noted that a pair of spaced longitudinal ribs are formed radially inwardly within opening 132 of lever 32 which fit into slots 174 and 178 of sleeve 168 to facilitate rotation of the sleeve upon actuation of the lever. Since arbor 96 is keyed to sleeve 168 by tab 186 on the underside of the sleeve, spring 94 will be compressed upon actuation of lever 32, by an operator. Compressed spring 94 will provide the force to return lever 32 to its home position upon release thereof by the operator. Opening 132 of lever 32 is formed with a transverse slot or depression in hub 128 and is positioned for alignment with a slot 330 formed in sleeve 168. A spring-biased detent or catch plate extends through slot 330 and into the depression of opening 132 to retain lever 32 with sleeve 168. A small hole extends from the outer surface of hub 128 and communicates with the depression in opening 132 to facilitate insertion of an implement to retract the spring-biased detent and permit extraction of lever 32 from the assembly.

Cylinder lock 44 is positioned within the axial opening 132 of hub 128 of lever 46 whereby the rib 122 and cover 124 are moved through and beyond lever slot 136 and into opening 134 of protrusion 130. Insert 48 is then assembled with lever 46 so that a portion of the insert covers slot 136 and another portion covers opening 134. This provides an exterior cover for slot 136 and opening 134 which blends structurally with and follows the contours of adjacent exterior portions of hub 128 and protrusion 130.

Lever 46, with cylinder lock 44 and insert 48 assembled therewith, is then manipulated to position axial opening 132 over sleeve 170. Ribs which are formed within opening 132 are moved into slot 174 of the sleeve and a slot of the sleeve which is diametrically opposite slot 174. Further, rib 122 and cover 124 of lock assembly 44 are moved into a slot on the far side of sleeve 170 equally spaced from slot 174 and the diametrically opposite slot. Eventually, a portion of the spring-biased detent or catch plate extends through slot 330 (FIG. 3) and sleeve 170 moves into a transverse slot or depression in hub 128 of lever 46 to retain the lever with sleeve 170 to complete assembly of cylindrical lock assembly 20. It is noted that sleeve 170 is formed with the same three-slot arrangement as sleeve 168 which is formed with slots 174, 176 and 178. Sleeves 168 and 170 are thereby interchangeable by merely rotating the sleeves vertically through one hundred and eighty degrees whereby slot 174 is on the bottom for the position of sleeve 168 and is on the top for the position of sleeve 170.

Figures 6, 7:
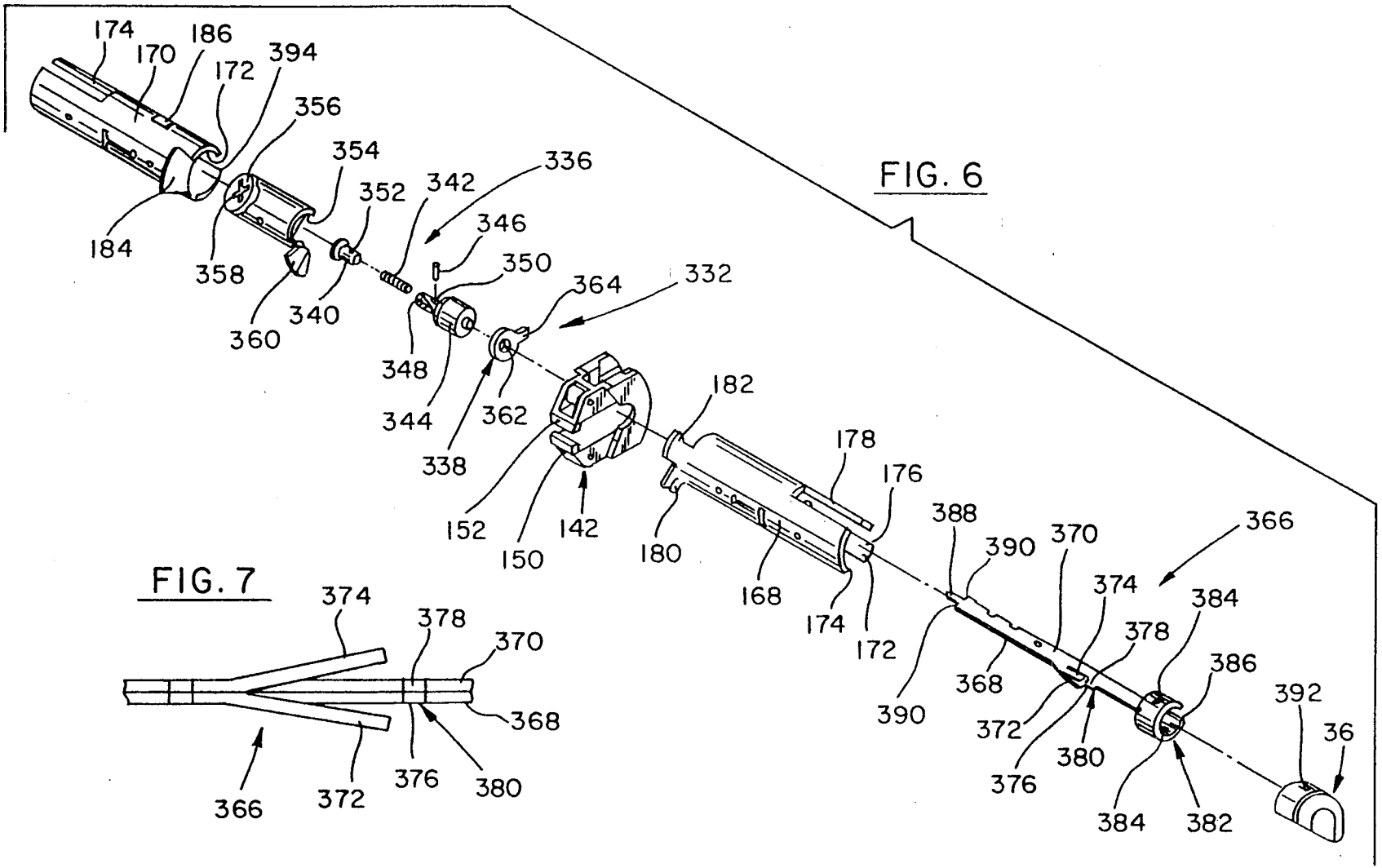
FIG. 6 is an exploded perspective view of a locking arrangement which can be used with the cylindrical lock assembly of FIG. 1.
FIG. 7 is a partial plan view of a linkage bar of the locking arrangement of FIG. 6.

Referring to FIG. 6, a lock mechanism 332 is illustrated with a portion of the elements of FIG. 1 to show an embodiment of a lock mechanism which functions with cylindrical lock assembly 20. It is to be understood that other lock mechanisms could be used without departing from the spirit and scope of applicants+ invention.

As illustrated, sleeves 168 and 170 are located on opposite sides of retractor 142 of chassis 50. Interposed between sleeve 170 and retractor 142 are an auxiliary sleeve or rollback 334, a plunger assembly 336 and a locking dog 338. Plunger assembly 336 includes a plunger head 340, a spring 342, a plunger body 344 and a pin 346. Spring 342 and head 340 are inserted into an opening 348 formed axially in one end of body 344. Pin 346 is then inserted through an elongated slot 350 and into a hole 352 formed in head 340. Spring 342 normally urges head 340 outwardly from opening 348 but is prevented from moving out of the opening by virtue of the assembly of pin 346. Also, since pin 346 is located within elongated slot 350, head 340 is permitted to travel axially with respect to opening 348 within the defined limits of the length of the slot.

Auxiliary sleeve 334 is formed with an axial opening 354 at one end thereof and a cover 356 at the other end thereof which is formed with a centrally located cross slot 358 located for reception of tailpiece 116 of cylinder lock 44. A camming element 360 is formed at the open end of auxiliary sleeve 334. Locking dog 338 is formed with an axial hole 362 and an ear 364 which extends radially from the hole. The free end of ear 364 is always contained within slot 254 of sleeve 248 (FIG. 3) to prevent rotation of dog 338 but to permit axial movement thereof.

A linkage bar 366 is positioned on the outboard side of sleeve 168 in axial alignment therewith as viewed in FIG. 6. Linkage bar 366 is formed by riveting together two flat strips 368 and 370 (FIG. 7) of metal. Strips 368 and 370 are formed with spring-biased fingers 372 and 374, respectively, along an intermediate edge, which flare away from the assembled strips as shown in FIG. 7. Strips 368 and 370 are also formed with tabs 376 and 378, respectively, which combine in assembly to form tab 380 of linkage bar 366. A cup-shaped cap 382 is attached to the outboard end of linkage bar 366 and is formed with a pair of oppositely spaced holes 384 and a slot 386. The opposite end 388 is reduced in width to form shoulders 390.

Turn button 36 is formed with a pair of oppositely spaced inwardly projecting tabs 392. Turn button 36 is positioned over cap 382 so that tabs 392 are placed into holes 384 to retain the button with the cap and with linkage bar 366.

In assembly, linkage bar 366 with turn button 36 are moved axially so that end 388 is first moved through sleeve 168, retractor 142 and opening 362 of dog 338. Opening 362 of dog 338 is designed to permit entry of end 388 and to permit the end and bar 366 to be rotated independently of the dog when turn button 36 is rotated and to permit shoulder 390 to move the dog axially. Plunger assembly 336 is inserted into opening 354 of auxiliary sleeve 334 which, in turn is positioned within opening 172 of sleeve 170. In this position, camming element 360 of auxiliary sleeve 334 is located adjacent to camming element 184 of sleeve 170.

Linkage bar 366 is moved further inwardly to move dog 338 further within sleeve 248 (FIG. 3) to a position in the vicinity of opening 172 of sleeve 170 adjacent camming element 184. In this position ear 364 of dog 338 is located for selective positioning into a slot 394 formed in sleeve 170. Plunger body 344 is pressing against end 388 of linkage bar 366 and dog 338 to provide spring biasing of the linkage bar and turn button 36 by virtue of spring 342.

As linkage bar 366 is moved through sleeve 168, fingers 372 and 374 move through a passage internally of the sleeve where they are pressed generally together and then spring back to the position shown in FIG. 7. This permits the free ends of fingers 372 and 374 to be positioned to engage shoulders within sleeve 168 to preclude complete retraction of linkage bar 366 from within the sleeve but to permit limited axial movement therein.

When linkage bar 366 is in the unlocked position, the bar is prevented from being rotated by a first tab blocking structure within sleeve 168 which prevents tab 380 from moving in an arcing direction. In this position, spring 342 is biasing dog 338 so that ear 364 is outside of slot 394 of sleeve 170 whereby the sleeve can be rotated by operation of lever 46. This results in movement of latchbolt 54 from the latched position to the unlatched position.

When it is desired to lock assembly 20 by use of turn button 36, the button is pushed axially inward whereby tab 380 clears the first tab blocking structure within sleeve 168. Turn button 36 can now be rotated to move tab 380 through an arc to a position on the inboard side of a second tab blocking structure within sleeve 168. When turn button 36 is released, tab 380 engages the second tab blocking structure and is pressed against the structure by spring 342 to retain linkage bar 366 and the turn button in this position.

As linkage bar 366 is moved inwardly and rotated as described above, shoulders 390 move dog 338 further through sleeve 248 (FIG. 3) to a position where ear 364 is located in slot 394 of sleeve 170. This prevents sleeve 170 from being turned whereby assembly 20 is the locked condition with respect to operation of the assembly by use of outside lever 46.

As previously described, cylinder lock 44 includes a tailpiece 116 (FIG. 1) which extends toward the inboard side of assembly 20. In assembling the components of assembly 20, tailpiece 116 is inserted into slot 358. When cylinder lock 44 is in the locked condition, tailpiece 116 is prevented from turning and assembly 20 is thereby locked from the outside. In this condition, latchbolt 54 can not be moved from the latched position by operation of outside lever 46. When a key is inserted into cylinder lock 44 and lock tumbler pins are thereby appropriately aligned, the key can be turned which results in turning of tailpiece 116. This turns auxiliary sleeve 334 whereby camming element 360 is moved to move retractor 142 and thereby retract latchbolt 54.

In the operation of lever 32, sleeve 168 is rotated to urge camming element 182 into cam surface 166 to move retractor 142 and thereby retract latchbolt 54 as described above. As retractor 142 is moved, there is a tendency for case 188 and chassis 50 to rotate. If such rotation occurred, chassis 50 could become misaligned with latchbolt 54 and create a binding amongst the elements.

To counter the rotational urge of the elements of chassis 50 upon movement of retractor 142, mounting blocks 258 and 260 are assembled within chassis 50 and attached to rose liners 26 and 38 in the manner described above.

It is to be understood that the same potential rotational reaction could result upon operation of lever 46.

Figure 8:
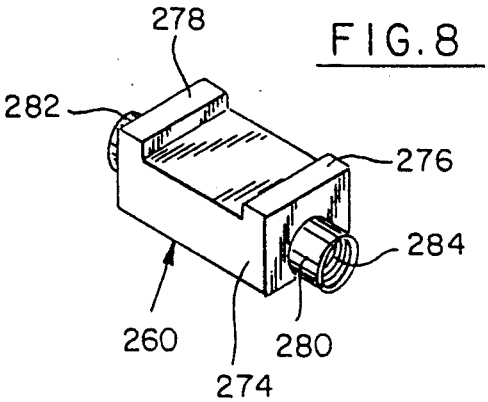
FIG. 8 is a perspective view of a mounting block contained within the chassis of FIG. 3 and embodying certain principles of the invention.
Figure 9:
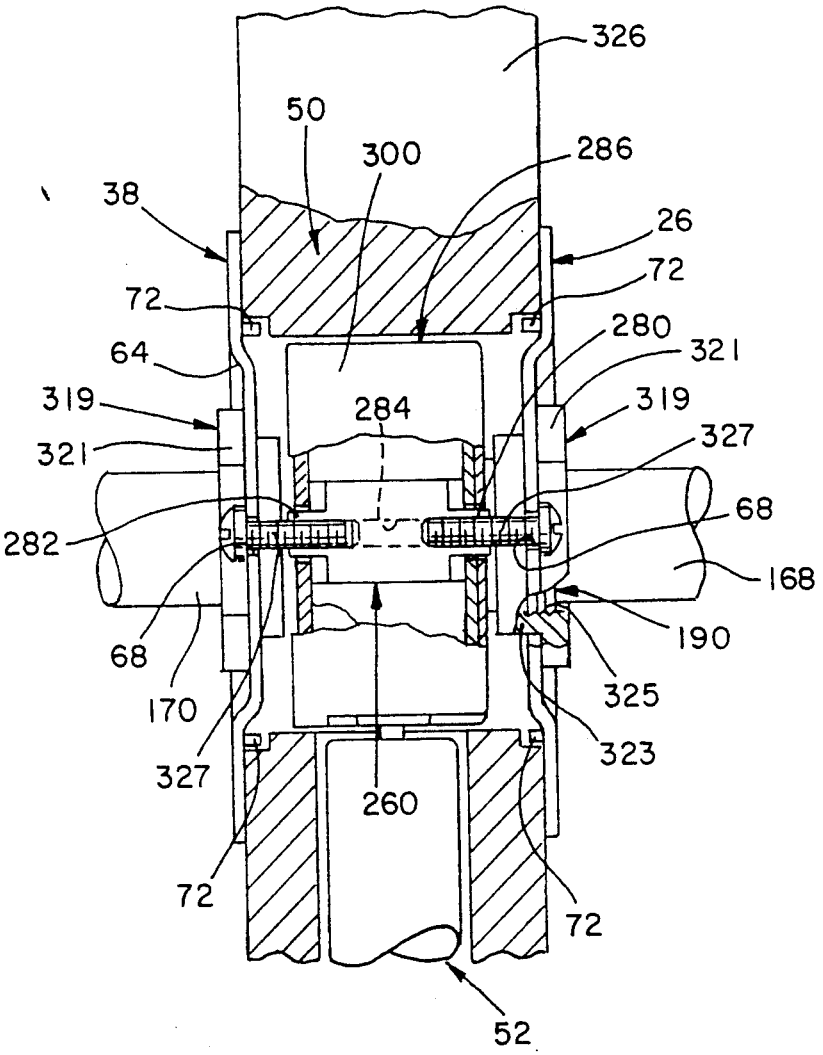
FIG. 9 is a plan view with parts broken away showing the chassis and mounting block assembled with a door in accordance with certain principles of the invention.

Referring to FIGS. 8 and 9, upper mounting block 260 is positioned so that pedestals 276 and 278 are located within notches 202 and 216 (FIG. 3) of case 188. Due to the dimensions of notches 202 and 216 and pedestals 276 and 278, mounting block 260 is precluded from any movement in the horizontal plane of the block. Leg 96 (FIG. 3) of case 188 prevents further inward movement of block 260 while the block is precluded from outward movement by housing 286. Thus, block 260 is captured in the installed position and prevented from moving in any direction.

In this arrangement, the ends of posts 278 and 280 extend to holes 68 in rose liners 26 and 38 and are aligned axially with the holes. A pair of screws 400 and 402 are inserted through holes 68 and chassis hole 296 on one side thereof and opening 288 on the other side thereof. Screws 400 and 402 are then threaded into opposite ends of threaded hole 284 and are drawn tight to secure the assembled elements of lock 20 as shown in FIG. 9.

It is noted that the identical assembly procedure is followed with respect to mounting block 258.

As described above, spring cassettes 28 and 40 are assembled over rose liners 26 and 38, respectively, with pads 82 of the cassettes being located within complementary slots 60 of the rose liners. This arrangement links cassettes 28 and 40 with rose liners 26 and 38 respectively, so that they cannot rotate relative to each other.

Thereafter, a screw is inserted through unthreaded hole 92 of cassette 28, through door 326 and the aligned slots 68 and into threaded hole 88 of cassette 40. In similar fashion, a screw is inserted through unthreaded hole 92 of cassette 40 and eventually into threaded hole 88 of cassette 28. The screws are then tightened to further secure the assembled elements together and with door 326.

By virtue of the manner of assembling blocks 258 and 260 within chassis 50 and thereafter securing the blocks to facilities external of the chassis as described, the mounting blocks restrict any rotational urging which may be transferred to the chassis.

Further, with this arrangement, rose liner 38 can be assembled at the factory as described above and preset to accommodate doors of a standard size such as, for example, a door with a one and three-quarter inch width. If doors of other widths are used, screws of different lengths, depending on the width of the door, can be used in place of screws 402 on blocks 258 and 260 to accommodate the change in width from the standard width.

Also, a hex nut could be placed over the threaded portion of sleeve 190 as viewed in FIG. 1 and would be located within opening 62 of rose liner 26 upon assembly. When screws 400 and 402 are assembled, the heads of the screws will overlap opening 62 to thereby capture the hex nut in the assembled position and thereby prevent the nut from loosening.

In summary, the use of blocks 258 and 260 provide for the prevention of rotational movement of chassis 50. Further, this arrangement provides and anchor point which will allow chassis 50 to be preset in the factory for a standard size door while allowing flexibility for using different length screws for nonstandard size doors. Also, the hex nut on sleeve 190 is prevented from loosening by virtue of the location of the heads of screws 400 and 402.

In general, the above-described embodiment is not construed as limiting the breadth of the present invention. Modifications, and other alternative constructions, will be apparent which are within the spirit and scope of the invention as defined in the appended claims.

We claim:

1. A cylindrical lock assembly for assembly with a door which comprises:

a latchbolt;

a chassis including a housing which contains a mechanism for moving the latchbolt between a latched position and an unlatched position;

a sleeve extending from the chassis and engageable with the mechanism for operating the mechanism upon rotation of the sleeve;

an operator mounted on the sleeve for facilitating selective rotation of the sleeve;

means positioned on the sleeve and attachable to the door for attaching the chassis to the door;

anti-rotation means contained within the chassis and having portions coupled externally of the housing to the attaching means for providing a resistive force within the housing to rotation of the chassis upon operation of the operator.

2. A cylindrical lock assembly as set forth in claim 1, wherein the attaching means is a rose liner.

3. A cylindrical lock assembly as set forth in claim 2 wherein the anti-rotation means comprises:

a mounting block having means formed therein for facilitating securance of the block to the rose liner.

4. A cylindrical lock assembly as set forth in claim 1 wherein the anti-rotation means comprises:

a block;

a nest formed in the chassis which encloses the block situated in the nest; and a threaded hole formed in the block to facilitate threaded attachment of the block to the attaching means.

5. A cylindrical lock assembly for mounting on a door which comprises:

a latchbolt;

a chassis containing a mechanism for moving the latchbolt between a latched positon and an unlatched position;

the chassis including a case formed with a nest and a housing enclosing the nest;

a sleeve extending from the chassis and engageable with the mechanism for operating the mechanism upon rotation of the sleeve;

an operator mounted on the sleeve for facilitating selective rotation of the sleeve;

means non-rotatably mounted on the door for attaching the chassis to the door; and means located in the nest and enclosed by the housing of the chassis to preclude movement thereof for facilitating securance of the attaching means to the chassis.

6. The cylindrical lock assembly as set forth in claim 5, wherein the nest includes a pair of spaced notches formed in a leg of the case and the facilitating means includes a pair of spaced pedestals extending from one surface of a body thereof with the pedestals being situated in the notches to preclude movement of the facilitating means into the case and movement in any direction on the leg.

7. The cylindrical lock assembly as set forth in claim 6, wherein in a threaded hole is formed at least at each end of and in the body to facilitate threaded attachment of the facilitaing means to the attaching means.

8. The cylindrical lock assembly as set forth in claim 7, wherein the body is further formed with a pair of posts extending from opposite ends thereof and formed with threaded holes which form extensions of the threaded holes formed in each end of the body.

9. The cylindrical lock assembly as set forth in claim 7, wherein the chassis includes a threaded sleeve extending therefrom with the attaching means positioned thereover; a threaded fastener having a locking surface thereon and positioned threadedly on the threaded sleeve; and a screw positioned through a hole in the attaching means and into the threaded hole at one end of the body to attach the attaching means to the chassis and the body; and a head of the screw located adjacent the locking surface of the threaded fastener to preclude loosening of the thereaded fastener.

* * * * *